US005772122A

United States Patent [19]

Sugiura et al.

[11] Patent Number: 5,772,122

[45] Date of Patent: Jun. 30, 1998

[54] FUEL INJECTION APPARATUS FOR AN INTERNAL COMBUSTION ENGINE

[75] Inventors: Masanari Sugiura, Nukata-gun; Sinobu Hirayama, Nishio; Kaoru Oda, Toyokawa, all of Japan

[73] Assignee: Nippondenso Co., Ltd., Kariya, Japan

[21] Appl. No.: 636,525

[22] Filed: Apr. 23, 1996

[30] Foreign Application Priority Data

Apr. 27, 1995 [JP] Japan ..... 7-103693

[51] Int. Cl.[6] ..... F02M 69/00

[52] U.S. Cl. ..... 239/408; 239/585.1

[58] Field of Search ..... 239/408, 417.3, 239/533.9, 533.12, 585.1, 585.3, 585.4, 585.5, 596

[56] References Cited

U.S. PATENT DOCUMENTS

| | | | |
|---|---|---|---|
| 4,519,370 | 5/1985 | Iwata | 123/432 |
| 5,301,879 | 4/1994 | Takeda et al. | 239/408 |
| 5,383,607 | 1/1995 | Heyse et al. | 239/585.4 |
| 5,409,169 | 4/1995 | Saikalis et al. | 239/404 |
| 5,411,212 | 5/1995 | Munezane et al. | 239/408 |
| 5,499,769 | 3/1996 | Namiki et al. | 239/409 |
| 5,556,034 | 9/1996 | Sakakida et al. | 239/417.3 |
| 5,655,715 | 8/1997 | Hans et al. | 239/408 |

FOREIGN PATENT DOCUMENTS

| | | |
|---|---|---|
| 4119206A | 12/1991 | Germany . |
| 4312756A1 | 10/1994 | Germany . |
| 4-362272 | 12/1992 | Japan . |
| 7-103102 | 4/1995 | Japan . |
| A-7-317628 | 12/1995 | Japan . |

OTHER PUBLICATIONS

Patent Abstracts of Japan, vol. 018, No. 164 (M–1579), 18 Mar. 1994 & JP 05 332223A (Nippondenso Co. Ltd.), 14 Dec. 1993.

*Primary Examiner*—Andres Kashnikow
*Assistant Examiner*—Lisa Ann Douglas
*Attorney, Agent, or Firm*—Nixon & Vanderhye P.C.

[57] ABSTRACT

Fuel injected from the cylindrical hole of a valve body passes through holes of an orifice plate and fuel holes of an assist sleeve. Collided and thus diverted first air flows collide with second air flows so as to sandwich fuel flows therebetween in a space at the upstream portions of the fuel holes. Each fuel flow is finely atomized while yet still maintaining directional control effected by the upstream orifice plate holes. Wall flow along the inner wall of a flow separator is suppressed, thus providing a fuel spray with improved atomization.

19 Claims, 10 Drawing Sheets

FUEL INJECTION APPARATUS FOR AN INTERNAL COMBUSTION ENGINE

CROSS REFERENCE TO RELATED APPLICATION

This application is based on and claims priority from Japanese application No. Hei. 7-103693 filed on Apr. 27, 1995, the content of which is incorporated herein by reference.

BACKGROUND OF THE INVENTION

1. Field of the Invention

The present invention relates to an atomization mechanism for atomizing fluid. More specially, the present invention relates to a fuel injection apparatus for an internal combustion engine, and is applied to an injection nozzle portion of an electromagnetic fuel injection valve for injecting and supplying fuel to an internal combustion engine for an automobile, for example.

2. Description of Related Art

Generally, in a fuel injection valve used for an internal combustion engine (hereinafter referred to as an "engine"), a valve member axially reciprocates in a guide hole and an injection hole open to a tip end of the valve body is opened and closed by vertical movement of the valve member. Therefore, the valve member is controlled precisely in lift amount when opened so as to secure a proper fuel injection amount.

In conventional fuel injection apparatus for an internal combustion engine disclosed in JP-A-4-362272, a fuel injection valve body having an injection hole through which fuel passes is provided with an adapter for injecting fuel from the injection hole through two branch holes. This adapter is provided with a fuel collision portion for causing fuel injected from the injection hole to collide with the upper end of branch portions of the two branch holes, the adapter being provided with an air introducing hole for injecting air toward the neighborhood of the upstream end of the fuel collision portion. This air introducing hole obliquely extends in a direction approaching toward the fuel injection valve as it is separated away from said two branch holes.

In another conventional fuel injection apparatus disclosed in DE-4312756A, air, which is introduced through an air introducing opening in the form of an annular slit, collides with the fuel spray, thereby facilitating atomization.

However, according to the conventional fuel injection apparatus for an internal combustion engine disclosed in JP-A-4-362272, directional control of fuel is performed by the adapter combined with the injection valve body. That is, in this injection valve, after fuel has collided with a fuel collision surface formed in the adapter, fuel is branched in flow by two branch holes, and directional control is performed by two branch holes. The fuel is not controlled in direction by a member other than the adapter.

Further, according to conventional fuel injection apparatus for an internal combustion engine disclosed in JP-A-4-362272, since high accuracy of dimension is required for the branch portion of the adapter combined with the injection valve body, there is a limit in increasing productivity for producing the injection apparatus by conventional precision machining of metal for an adapter part, thus causing a problem in high cost.

Furthermore, according to conventional fuel injection apparatus for an internal combustion engine disclosed in JP-A-4-362272, an air flow passes in one direction and collides with fuel injected from the injection hole of the injection valve body after being changed in its direction by colliding with a collision portion 201 at the tip end of the fuel branch portion, as shown in FIG. 17. Therefore, fuel is deposited on the wall surface of an adapter 200 so as to form a fuel wall flow flowing toward the outlet of branch holes 202 and 203, and as a result, the particle diameter of fuel injected from the branch holes 202 and 203 becomes large, thereby deteriorating fuel atomization. Thus, there is a problem in that an unburned portion of HC in exhaust or the like increases and the fuel atomizing effect of an air assist, which is the main object of the fuel injection apparatus according to the present invention, is deteriorated.

Further, in the fuel injection apparatus disclosed in DE 4312756A1, since the air flow collides with the fuel spray from the periphery of the fuel spray, the fuel spray is deposited on the separator for separating the fuel flow into the spray passages to increase the particle diameter of fuel or to produce drops of fuel. As a result, unburned components such as HC in exhaust gases increase, thus causing a problem in that the fuel atomizing effect by the air assist for fuel atomization is deteriorated.

Furthermore, since the air introducing opening is in the form of an annular slit, an opening area of the air introducing opening is likely to be decreased due to the deposit and the air introducing quantity is reduced, thereby deteriorating the fuel atomization.

SUMMARY OF THE INVENTION

An object of the present invention is to provide a fuel injection apparatus for an internal combustion engine, which can properly perform highly-improved fuel atomization and the precise direction control.

A further object of the present invention is to provide a fuel injection apparatus for an internal combustion engine, which can provide both directional control and atomization control of injection fuel with less cost by devising a sleeve combined with the injection valve body.

Another object of the present invention is to provide a sleeve which can atomize fluid so as to have fine particles.

A further another object of the present invention is to provide an injection apparatus which can atomize fluid so as to have fine particles.

According to the fuel injection apparatus for an internal combustion engine of the present invention, fuel injected from the cylindrical hole of the valve body passes through a plurality of holes of a multi-hole nozzle and a plurality of fuel holes of the atomization mechanism. At this time, fuel atomization and injection direction are primarily determined in advance by the multi-hole nozzles combined with the injection valve body, and the unevenness of fuel flow is secondarily controlled by the plurality of fuel holes of a sleeve provided on the outlet side of the multi-hole nozzle.

When air is not supplied into the atomization mechanism, fuel controlled in direction by the multi-hole nozzle is injected passing through the fuel hole having a larger diameter than the hole in the atomization mechanism. In the case where the fuel flow after having passed through the multi-hole nozzle has an "uneven flow", this uneven flow is corrected in a controlling direction of the fuel hole of the atomization mechanism. Therefore, highly-improved fuel atomization and precise fuel directional control can be performed by a simple configuration.

When air is supplied into the atomization mechanism, fuel flow is further finely atomized by collision of first air flow and second air flow so as to sandwich fuel flow therebetween in space portion of a atomization mechanism. Even if the fuel flow collides with air, the directional characteristics of the main fuel flow are not deteriorated, because it maintains the direction controlled by the plurality of holes of the multi-hole nozzle. The "main flow" of the fuel flow after having passed through the multi-hole nozzle is injected from the outlet of the fuel hole of the atomization mechanism while maintaining the direction controlled by the plurality of holes of the multi-hole nozzle whereas "uneven flow" of the fuel flow after having passed through the multi-hole nozzle is controlled in the controlling direction of the fuel hole of the sleeve. Therefore, highly-improved fuel atomization and precise fuel directional control can be performed by a simple configuration.

Further, the spray fuel is sandwiched between air flows to prevent spray from being deposited on the wall surface which forms fuel holes of the atomization mechanism. Accordingly, it is possible to prevent the particle diameter of fuel from being increased and fuel drops from being produced, thus reducing unburned components such as HC in exhaust gases.

The number of first air flows may be set to 2 or 4 in correspondence with the specification of the internal combustion engine to obtain the injection mode as desired.

The air flow may be introduced so as to sandwich fuel flow and substantially perpendicular to fuel flow. Therefore, it is possible to facilitate atomization of fuel by effectively making use of the energy of air flow which collides with fuel flow.

Since air flows may collide with the fuel flow at right angles, it is possible to facilitate atomization of fuel.

Since the air flow may collide with the fuel flow on the same plane, the collision energy of air flows are added to facilitate atomization of fuel.

For example, even if the same amount is deposited, as compared with the air introducing opening in the form of an annular slit, it is possible to increase a substantial passage area of the air introducing opening.

Since a separator may be provided to separate the fuel flow into each of the fuel holes, definite flow direction can be provided for the fuel flow.

According to the sleeve of the present invention, the fluid is sandwiched between air flows to prevent the spray passage wall surface from being deposited with spray. Accordingly, it is possible to prevent the particle size of the spray from being increased and drops of the fluid from being produced from the spray passage outlet to provide a sleeve which can facilitate atomization of the fluid and which is stable in the spray flowing direction.

Since a space portion in which the spray is sandwiched before flowing into the spray passage (by secondary air flow produced by collision with the first air flow and the second air flow) may be formed, the spray is securely sandwiched between air flows and the spray flow direction is stabilized.

BRIEF DESCRIPTION OF THE DRAWINGS

Additional objects and advantages of the present invention will be more readily apparent from the following detailed description of preferred embodiments thereof when taken together with the accompanying drawings in which:

FIG. 14A is a bottom view of the orifice plate as seen from a downstream side with respect to fuel flow, and FIG. 14B is a cross-sectional view of fuel flow;

FIG. 15A is a bottom view of the orifice plate as seen from a downstream side with respect to fuel flow, and FIG. 15B is a cross-sectional view of fuel flow;

FIG. 16A shows a modification where the number of the orifices is four, FIG. 16B shows another modification where the number of the orifices is six, and FIG. 16C shows further another modification where the number of the orifices is eight.

DETAILED DESCRIPTION OF THE PREFERRED EMBODIMENTS

Embodiments of the present invention will be described hereinafter with reference to the drawings.

A first embodiment in which the present invention is applied to the fuel injection valve of a fuel supply device for a gasoline engine is described with reference to FIGS. 1 to 4.

Figure 2:
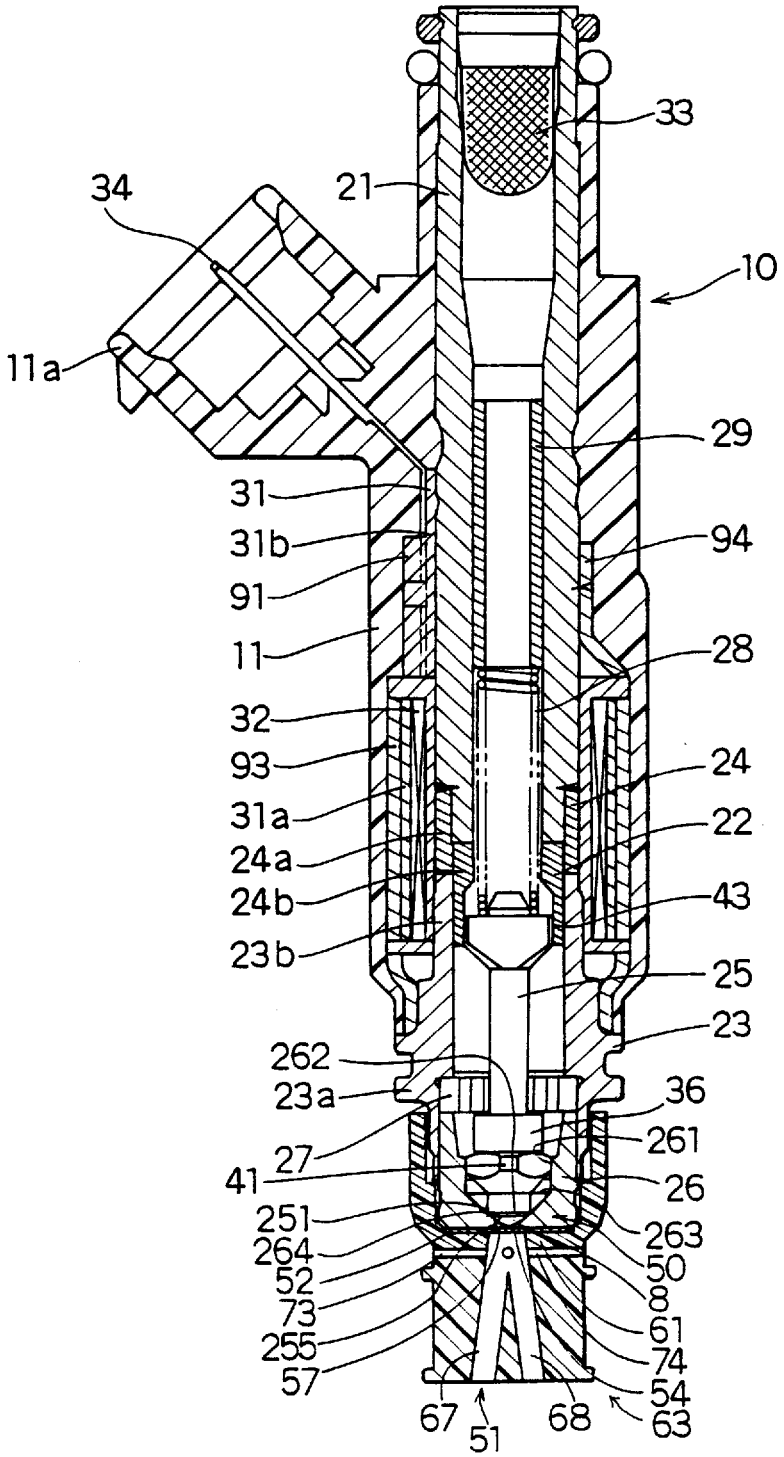
FIG. 2 is a cross-sectional view of the fuel injection apparatus for an internal combustion engine according to a first embodiment.

A fuel injection valve will be described with reference to FIG. 2. As shown in FIG. 2, in a housing mold 11 made of resin, stationary core 21, spool 91, electromagnetic coil 32, coil mold 31 and metal plates 93 and 94 for forming a magnetic path are integrally molded.

The stationary core 21 is made of a ferromagnetic material and is provided within housing mold 11 so as to protrude upwardly of coil mold 31. An adjusting pipe 29 is secured to the inner wall of stationary core 21.

Electromagnetic coil 32 is wound around the outer periphery of resin spool 91 and, resin coil mold 31 is molded in the outer periphery of spool 91 and electromagnetic coil 32, the electromagnetic coil 32 being surrounded by the coil mold 31. Coil mold 31 includes a cylindrical tubular portion 31*a* for protecting electromagnetic coil 32, and a protrusion portion 31*b* for protecting a lead wire electrically connected with the electromagnetic coil 32, and a protrusion portion 31*b* protruding upward from the tubular portion 31*a* for holding a terminal 34 described later. A spool 91 and the electromagnetic coil 32 are mounted on the outer periphery of the stationary core 21 in the state integrated by the coil mold 31.

Two metal plates 93 and 94 are provided so that an upper one end comes in contact with the outer periphery of the stationary core 21 and a lower other end comes in contact with the outer periphery of a magnetic pipe 23 and includes a member for forming a magnetic path in which magnetic flux passes when the electromagnetic coil 32 is energized, the metal plates being coated on the outer periphery of the tubular portion 31*a* so as to hold the tubular portion 31*a* from both sides. The electromagnetic coil 32 is protected by the two metal plates 93 and 94.

A connector portion 11*a* protruding from the outer wall of the housing mold 11. A terminal 34 electrically connected to electromagnetic coil 32 is embedded in connector portion 11*a* and coil mold 31. The terminal 34 is connected to an electronic control device (not shown) through a wire harness.

One end of compression spring 28 is placed in contact with a spring seat surface on movable core 22, and the other end is placed in contact with the bottom of adjusting pipe 29. The compression spring 28 biases movable core 22 and needle 25 downward in FIG. 2 to seat a seat portion of needle 25 on valve seat 264 of valve body 26. When an exciting current flows from terminal 34 to electromagnetic coil 32 through a lead wire from an electronic control device (not shown), needle 25 and movable core 22 are attracted toward the stationary core 21 against the biasing force of compression coil spring 28.

A non-magnetic pipe 24 is connected to the lower portion of stationary core 21. One end 24*a* is connected to the lower portion of stationary core 21 so a part thereof protrudes from the lower end of stationary core 21. A small diameter portion 23*b* of a ferromagnetic pipe 23 is connected to the lower end of the other end 24*b* of non-magnetic pipe 24. The other end 24*b* of non-magnetic pipe 24 forms a guide portion for movable core 22.

The ferromagnetic movable core 22 is formed in a tube shape in the internal space of non-magnetic pipe 24 and magnetic pipe 23. The outer diameter of movable core 22 is set to be sightly smaller than the inner diameter of other end 24*b* of non-magnetic pipe 24, and movable core 22 is slidably supported on non-magnetic pipe 24. The upper end of movable core 22 opposes the lower surface of stationary core 21 so as to form a predetermined clearance.

A needle 25 is formed at the upper portion thereof with a joining portion 43. The joining portion 43 and the movable core 22 are laser-welded so that the needle 25 and the movable core 22 are integrally connected. A double-chamfered portion as a fuel passage is provided in the outer periphery of the joining portion 43. Above the stationary core 21 is provided a filter 33 for removing foreign material such as dust in fuel which is pressurized and supplied by a fuel pump or the like from a fuel tank and flows into the fuel injection valve 10.

The fuel flowing into the stationary core 21 through the filter 33 passes through a clearance with the double-chamfered portion formed in the joining portion 43 of the needle 25 from an adjusting pipe 29, and a clearance with a fourth-chamfered portion formed in the cylindrical surface 261 of the valve body 26 and a sliding portion 41 of the needle 25, further reaches a valve portion consisting of a seat portion 251 of the needle 25 and a valve seat 263, and finally reaches a cylindrical surface 264 for forming a cylindrical hole 8 from the valve portion.

Next, a structure of a discharge portion 50 of the fuel injection valve 10 is described.

The valve body 26 is inserted into the large diameter portion 23*a* of the magnetic pipe 23 through a hollow disk-like spacer 27 and is laser-welded. The thickness of the spacer 27 is adjusted so as to maintain an air gap between the stationary core 21 and the movable core 22 at a predetermined value. The inner wall of the valve body 26 is formed with a cylindrical surface 261 where the sliding portion 41 of the needle 25 slides and a valve seat 263 on which a conical seat portion 251 of the needle 25 is seated. Further, a cylindrical hole 8 formed in the cylindrical surface 264 is provided in the central portion of the bottom of the valve body 26.

The needle 25 is formed with a flange 36 so as to oppose with a predetermined clearance the lower end of the spacer 27 contained in the inner wall of the large diameter portion 23*a* of the magnetic pipe 23. The flange 36 is formed on the side of the seat portion 251 formed at the tip end of the full length of the needle 25, and a sliding portion 41 which is slidable on the cylindrical surface 261 formed in the valve body 26 is formed at the lower portion of the flange 36.

A flow control mechanism 51 is provided at the outlet of the cylindrical hole 8 of the valve body 26. The flow control mechanism 51 consists of (1) a needle 25, (2) a valve body 26, (3) a multi-hole nozzle 61, and (4) an air assist sleeve 63. Features of these components are described in detail in this order.

(1) Needle 25

Figure 1:
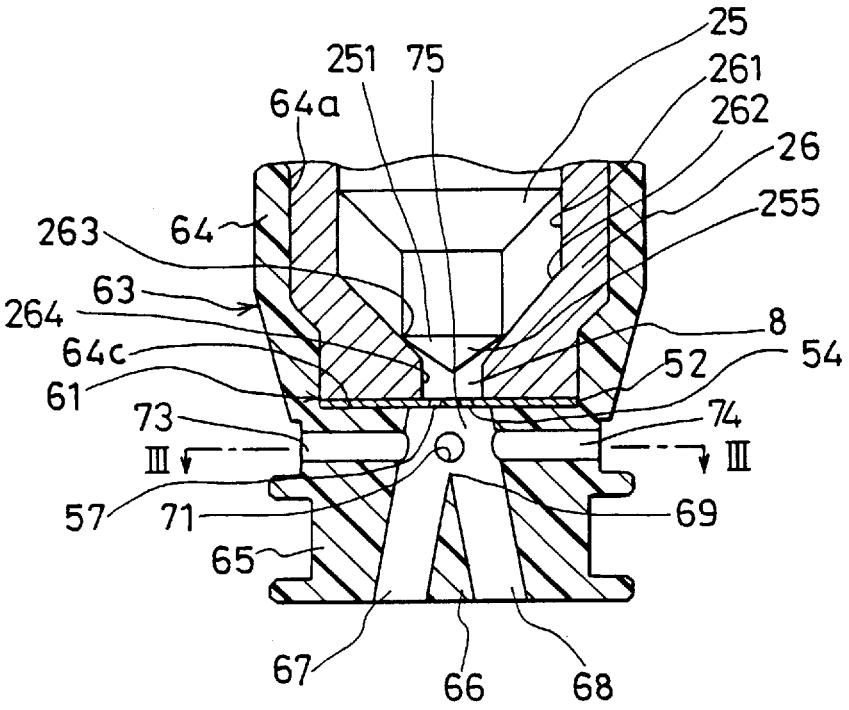
FIG. 1 is a cross-sectional view of main portions of a fuel injection apparatus for an internal combustion engine according to a first embodiment.

The needle 25 is formed at the tip end thereof with a conical surface 255, as shown in FIG. 1. In the present invention, it may be a spherical surface or a curved surface similar to the spherical surface instead of the conical surface. FIG. 1 shows a closed state of the valve where a contact point is formed between the seat portion 251 and the valve seat 263, and a set of these contacts forms an annular line.

(2) Valve body 26

The valve body 26 includes a cylindrical surface 261, a conical slant surface 262 and a cylindrical surface 264 for forming the cylindrical hole 8, and a border line of the surfaces 261, 262 and 263 is circular.

(3) Multi-hole nozzle 61

Figure 4:
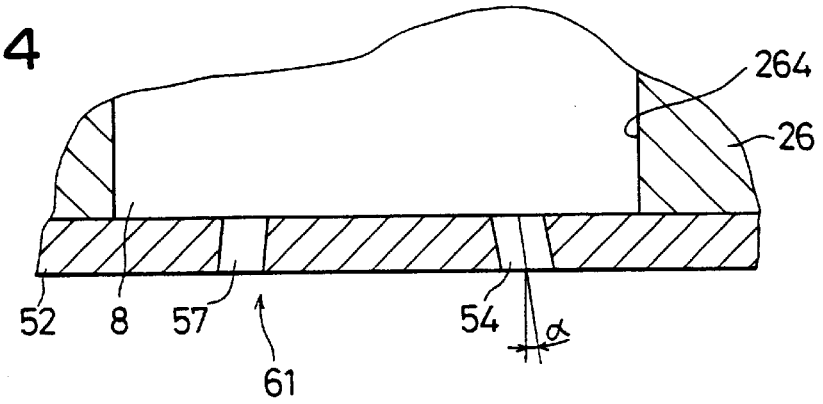
FIG. 4 is an enlarged cross-sectional view of a multi-hole nozzle at an outlet of a valve body in the first embodiment.

The multi-hole nozzle 61 is composed of an orifice plate 52 in this embodiment. This orifice plate 52 is made of stainless steel, for example, and constitutes a part of the flow control mechanism 51. The orifice plate 52 is joined to the tip end of the valve body 26 by welding such as welding at an entire circumference. As shown in FIG. 4, four orifices 54, 55, 56 and 57 (55, 56 are not shown) are concentrically formed at the orifice plate so as to pass therethrough in the direction of plate thickness. The orifices 54, 55, 56 and 57 are formed into a cylindrical shape, and a cylindrical center axis is inclined by an inclination angle $\alpha$ from the line in the direction of the plate thickness.

Figure 5:
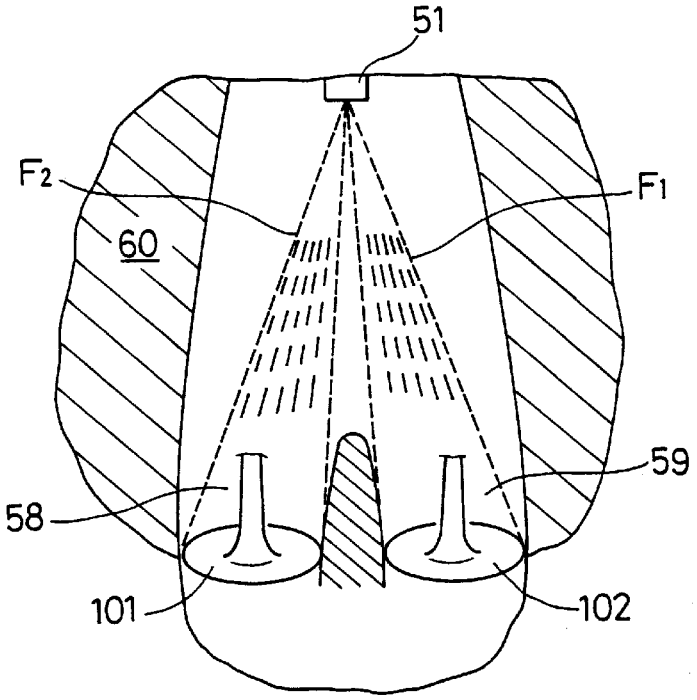
FIG. 5 is an explanatory view of a fuel flow injected from a flow control mechanism according to the first embodiment.

In this embodiment, a two-direction atomization is shown. That is, an inclination angle of the orifices is determined so that fuel flows injected from the orifices 54 and 55 joins integrally. Similarly, an inclination angle of the orifices is determined so that fuel flows injected from the orifices 56 and 57 also joins integrally. Accordingly, as shown in FIG. 5, a fuel flow F1 is injected from the orifices 54 and 55 toward a bevel portion of an intake valve 102 provided on one intake passage 59 of an engine head 60, and a fuel flow F2 is injected from the orifices 57 and 56 toward a bevel portion of an intake valve 101 provided on the other intake passage 58. The inclination angle $\alpha$ of the orifices 54, 55, 56 and 57 is preferably in the range of $10 \leqq \alpha \leqq 40(°)$, and the value of $\alpha$ is suitably set in accordance with the specification of the engine.

(4) Air assist sleeve 63

An air assist sleeve 63 made of resin is integrally formed by molding with a forming die, as shown in FIGS. 1 and 2. The air assist sleeve 63 is press-fitted in and secured to the outer periphery at the tip end of the valve body 26. The air assist sleeve 63 consists of a cylindrical mounting portion 64 and a cylindrical guide 65.

The mounting portion 64 is fitted in the outer peripheral wall of the valve body 26 of the fuel injection valve 10 and includes a fitting hole 64*a* fitted in the outer peripheral portion of the valve body 26.

The guide portion 65 cylindrically extends from a recess groove 64*c* of the mounting portion 64 and includes a separator 66 at the side of the fuel outlet. The guide portion 65 includes two fuel holes 67 and 68 branched from the separator 66, and these two fuel holes 67 and 68 communicate with a cylindrical hole 8 at the inlet.

The cross-section of the fuel holes 67 and 68 are circular so as to have a larger diameter than that of the orifices 54, 55, 56 and 57. These fuel holes 67 and 68 pass through the side opposite to the valve body 26 at a linear predetermined angle. The orifices 54, 55, 56 and 57 are open in the central portion of the fuel holes 67 and 68. The inner diameter of the fuel holes 67 and 68 is constant in the extending direction and are circular in shape. At the side of the inlet, the fuel hole 67 communicates with the fuel hole 68, and at the side of the outlet, these holes 67 and 68 are branched by the separator 66. The branch portion of the fuel holes 67 and 68 has an acute angle.

Figure 3:
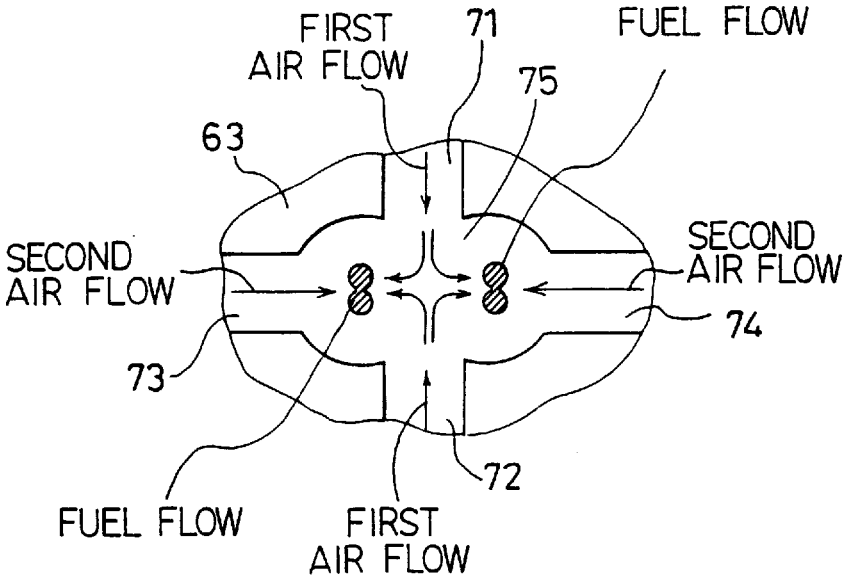
FIG. 3 is an enlarged view of a central portion taken along the line III—III of FIG. 1.

Air holes 71 and 72 communicate between the outside and inside of the air assist sleeve 63 as shown in FIGS. 1 and 3, and supply an air flow from the outside to the fuel holes 67 and 68. As shown in FIG. 3, the first air holes 71, 72 and the second air holes 73, 74 are linear cylindrical holes, respectively. The first air holes 71, 72 and the second air holes 73, 74 are disposed on a plane perpendicular to the axial direction of the air assist sleeve 63 and directed in the direction perpendicular to each other. The first air holes 71 and 72 extend in the direction in which the first air flows are formed in the direction of collision with each other between portions branched in a bifurcated manner of the fuel holes 67 and 68. The second air holes 73 and 74 extend in the direction in which the second air flows flow from the outside of the sleeve to the inside of the sleeve in the direction sandwiching the fuel flows of the fuel holes 67 and 68 branched in a bifurcated manner from opposite sides. Each of the first air flows and the second air flows are introduced substantially perpendicular to the fuel flow. The first air flows flowing from the first air holes 71 and 72 collide therein. The atomization of fuel is facilitated while the fuel flow flowing through the fuel holes 67 and 68 is sandwiched by the first air flows and the second air flows from the second air holes 73 and 74 collided as shown in FIG. 3. The fuel flows are sandwiched by the first air flows and the second air flows in the space located at a more inlet side than the acute angle portion 69 of the separator 66. That is, the fuel flow collides with the air flow at the space where the fuel holes 67 and 68, the first air holes 71 and 72, and the second air hole 73 and 74 cross to facilitate the atomization of fuel in the space. As described in detail in a third embodiment, air flows along the wall surface obtained by the first air flows colliding with each other and functioning as an air curtain. The wall flow flowing along the wall surface of the separator 66 is thereby reduced.

According to the first embodiment, the air flows supplied from the first air holes 71 and 72 and the second air holes 73 and 74 collides with the fuel flows injected from the orifices 54, 55, 56 and 57 of the orifice plate 52 after joining integrally, and are changed into a finely atomized fuel spray having fine fuel particles at the inlet of the separator 66. The air amount supplied to the first air holes 71 and 72 and the second air holes 73 and 74 is controlled by a valve-open portion of an air supply passage sucked by negative pressure of an intake pipe, for example. The fuel passing through the fuel holes 67 and 68 is controlled in direction by the shape or size of the orifices 54, 55, 56 and 57 which is opened at the orifice plate 52 in advance. When the air flow supplied from the first air holes 71 and 72 and the second air holes 73 and 74 collides with the fuel flow passing through the fuel holes 67 and 68, the fuel is atomized, and the atomized fuel is injected in the desired direction from the fuel holes 67 and 68.

According to the first embodiment, the fuel flow which is controlled in direction by the orifices 54, 55, 56 and 57 of the orifice plate 52 is further guided by the fuel holes 67 and 68 in the air assist sleeve 63, and the fuel flow controlled in direction by these elements is supplied to the intake system of the engine as desired. If the assist air is supplied from the first air holes 71 and 72 and the second air holes 73 and 74 at this time, the air passing through the air holes 71, 72, 73 and 74 facilitates the atomization of the fuel flow within the air assist sleeve 63, thus supplying the atomized fuel having the preferable spray condition with the intake system of the engine side from the fuel holes 67 and 68. The direction control of the fuel flow at the primary side is performed by the orifices 54, 55, 56 and 57 of the orifice plate 52, and that at the secondary side is auxiliarily performed by the fuel holes 67 and 68. Accordingly, the direction control of the fuel flow is basically performed by the orifice plate 52. The fuel holes 67 and 68 of the air assist sleeve 63 function to assist the direction control and further function to improve the spray condition of the atomized fuel.

According to the first embodiment, the fuel in the air assist sleeve 63 collides with air at the space where the fuel holes 67 and 68 cross with the air holes 71, 72, 73 and 74, and the first air flows flown from the first air holes 71 and 72 collide in the central portion to constitute flows in left and right directions in FIG. 3. Since the second air flows flow into the inside through the second air holes 73, 74 from the left and right directions, the first air flow and the second air flow collide with the fuel flow, and the fuel flow is maintained so as to be sandwiched in the space from the two directions to reduce the adhesion to the wall surface of the separator 66. In this way, the wall flow of the fuel is reduced so that the atomization of fuel at the time of performing the air assist is improved. Further, since the space is provided on the upper end side of the separator 66 and the first air holes 71 and 72 and the second air holes 73 and 74 are formed in a direction vertical to the axis of the air assist sleeve 63, the air sleeve 63 is downsized.

A second embodiment of the present invention is described with reference to FIG. 6.

Figure 6:
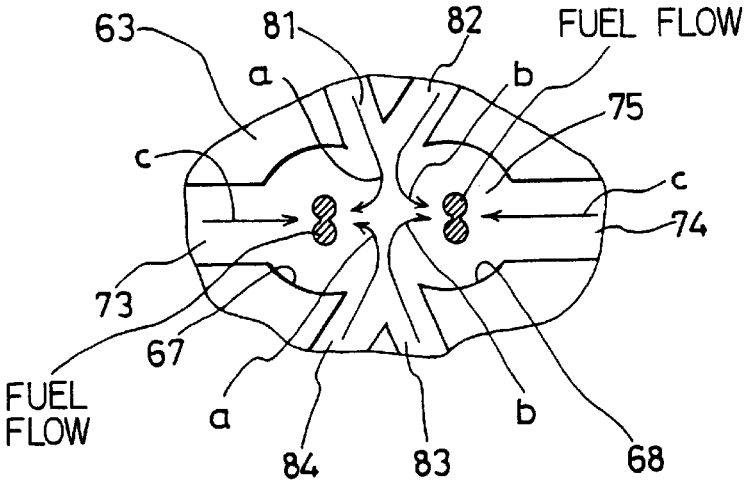
FIG. 6 is an enlarged view of a central portion corresponding to that shown in FIG. 3 of the fuel injection apparatus for an internal combustion engine according to a second embodiment.

In the second embodiment shown in FIG. 6, the number of the first air holes forming the air assist sleeve 63 is four, and that of the second air holes is two.

As shown in FIG. 6, first air holes 81 and 82 and first air holes 83 and 84 are cylindrical holes extending through the fuel holes 67 and 68 from the outside of the air assist sleeve 63 toward the inside of the air assist sleeve 63. Other parts are similar to those of the first embodiment, and therefore, the same or equivalent parts are indicated with the same reference numerals, the description of which is omitted.

According to the second embodiment, the first air flows supplied from the first air holes 81, 82, 83 and 84 collide in the space of a common portion of the fuel hole 67 and the fuel hole 68 and flow in a direction opposite to the left and right directions indicated by arrows "a" and "b". On the other hand, the air flow is guided as shown by arrow "c" from the second air holes 73 and 74 to the fuel holes 67 and 68, and the first air flow collides with the second air flow. Air collides at a position at which it collides with the fuel flow in the space of the fuel holes 67 and 68. Accordingly, the atomization of fuel is facilitated. Since the fuel is not blown against the separator 66, the wall flow of the fuel flow is reduced, and the atomization of the fuel injected from the outlets of the fuel holes 67 and 68 is facilitated.

In the above-described embodiment, both the first air hole and the second air hole are cylindrical in shape, but the cross-sectional shape of the air hole in the present invention is not limited thereto. Further, the first air hole and the second air hole are provided in the plane perpendicular to the axial direction of the air assist sleeve, however, the provision thereof is not limited thereto. For example, the first air hole and the second air hole may be extended in the inclined direction.

Further, while in the above-described embodiment, the orifice plate 52 in the form of a sheet is used as the multi-hole nozzle 61, it is to be noted that means for performing the direction control of fuel is not limited to the aforesaid plate-like configuration.

A third embodiment of the present invention is described with reference to FIGS. 7 to 12. Component parts which are substantially the same as those of the first embodiment are indicated with the same reference numerals, and the description thereof is omitted.

Figure 7:
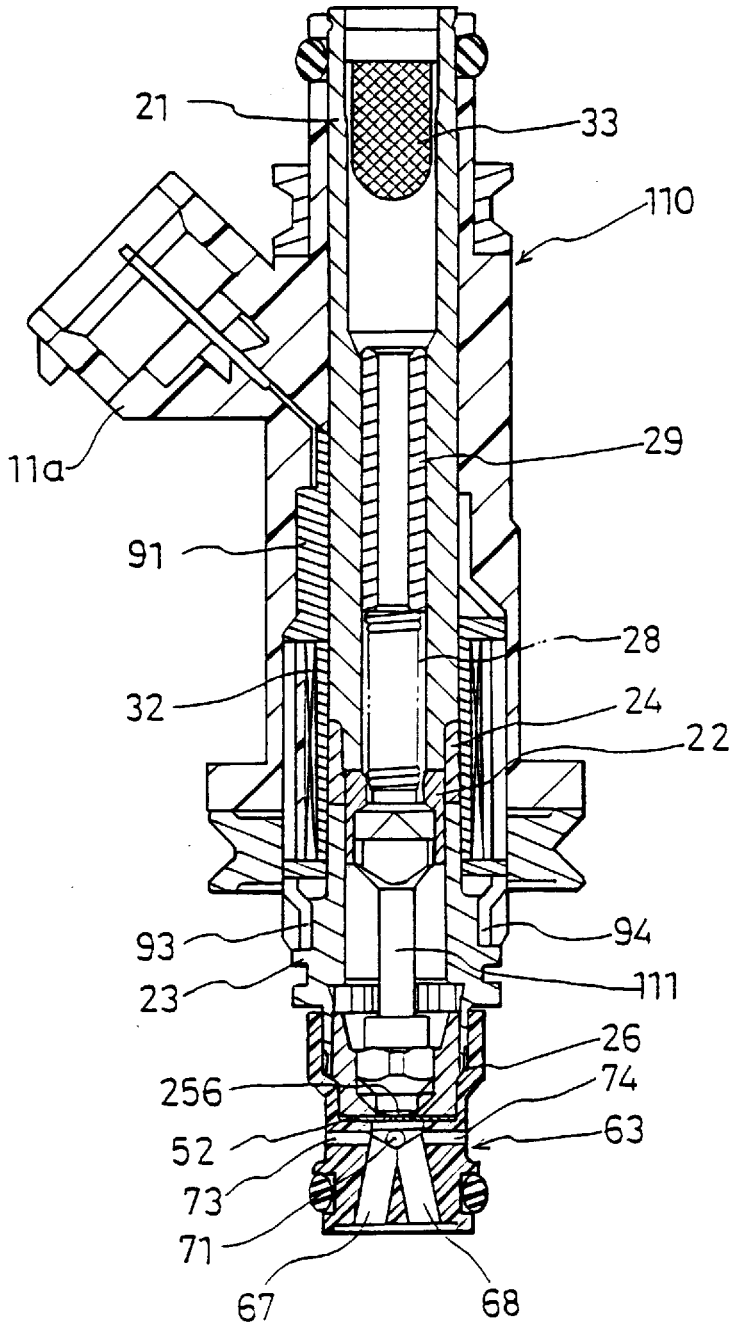
FIG. 7 is a cross-sectional view of the fuel injection apparatus for an internal combustion engine according to a third embodiment.
Figure 8:
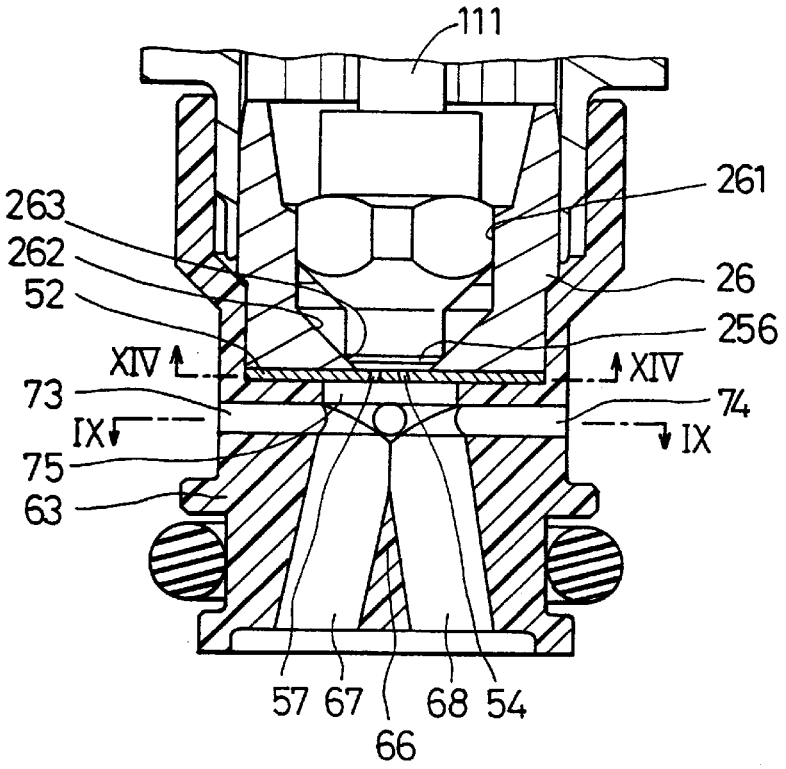
FIG. 8 is a cross-sectional view of main portions of the fuel injection apparatus for an internal combustion engine according to the third embodiment.
Figure 9:
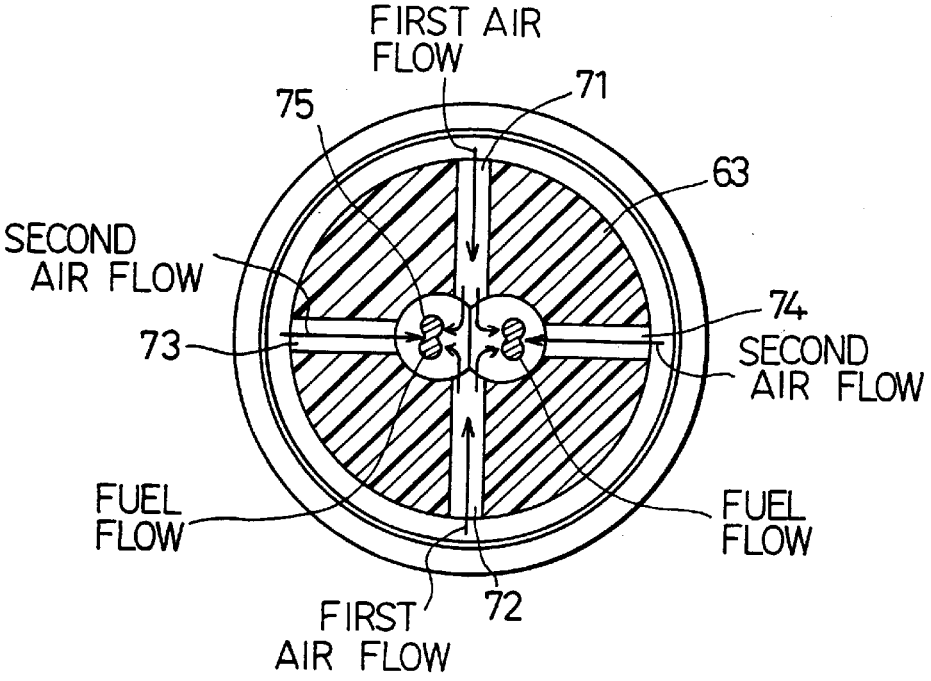
FIG. 9 is a cross-sectional view taken along the line IX—IX of FIG. 8.
Figure 13:
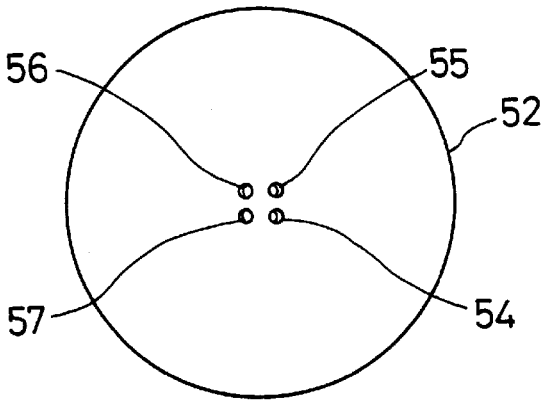
FIG. 13 is a bottom view of the orifice plate in the third embodiment as seen from a downstream side with respect to fuel flow.

In a fuel injection valve 110 in the third embodiment shown in FIG. 7, a seat portion 256 of a needle 111 as a valve member is formed to be a relatively flat curved surface as shown in FIG. 8, and the distance from the seat portion 256 to the plane on the needle side of an orifice plate 52 is short. That is, a space formed between the seat portion 256 and the orifice plate 52 is shortened. At the orifice plate 52, four orifices 54, 55, 56, and 57 are arranged at peak points of a square, as shown in FIG. 13. The orifices 54 and 55 are formed so as to incline toward the right side from the axis center in FIG. 8, i.e., in the direction separating away, as these orifices 54 and 55 go in the fuel injection direction, whereas the orifices 56 and 57 are formed so as to incline toward the left side from the axis center in FIG. 8, i.e., in the direction separating away, as these orifices 56 and 57 go in the fuel injection direction.

Next, the fuel flow when the needle 111 is apart from the valve seat 263 is described with respect to (1) the upstream side of the orifice and (2) the downstream side of the orifice.

(1) When the seat portion 256 is apart from the valve seat 263, fuel flows toward the orifice plate 52 along the conical slant surface 262 from a clearance between the seat portion 256 and the valve seat 263. Since the seat portion 256 is formed to be a relatively flat curved surface, the fuel flowing toward the orifice plate 52 tends to produce a flow substantially parallel with the orifice plate 52 along the seat portion 256. The fuel flows flowing toward the center of the orifice plate 52 substantially parallel with the orifice plate 52 include (1) a fuel flow directly flowing toward each orifice from the outside in the radial direction of the orifice plate 52, and (2) fuel flows which collide with each other at the center of the orifice plate 52 and are U-turned back toward the outside in the radial direction from the center of the orifice plate 52. The fuel flows (1) and (2) collide directly above upstream of each orifice and increase the collision energy of the fuels to facilitate the atomization of fuel. The fuel atomized at the upstream side of the orifice plate 52 is injected toward the downstream side of the orifice plate 52 from each orifice.

Figure 10:
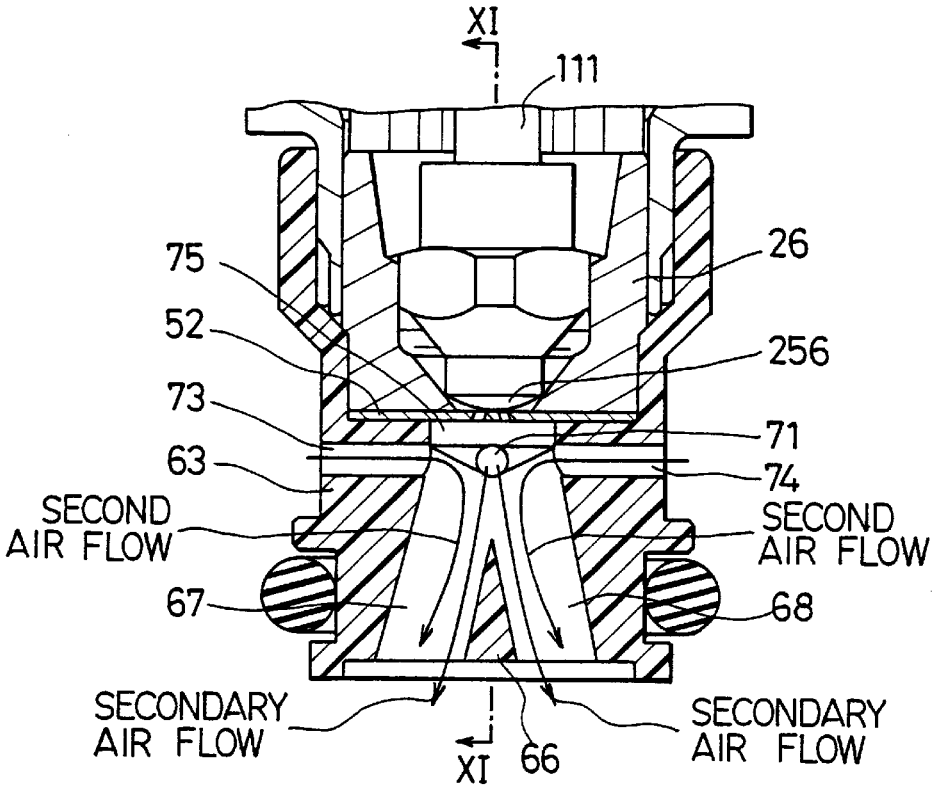
FIG. 10 is an explanatory view of the air flow in the third embodiment.
Figure 11:
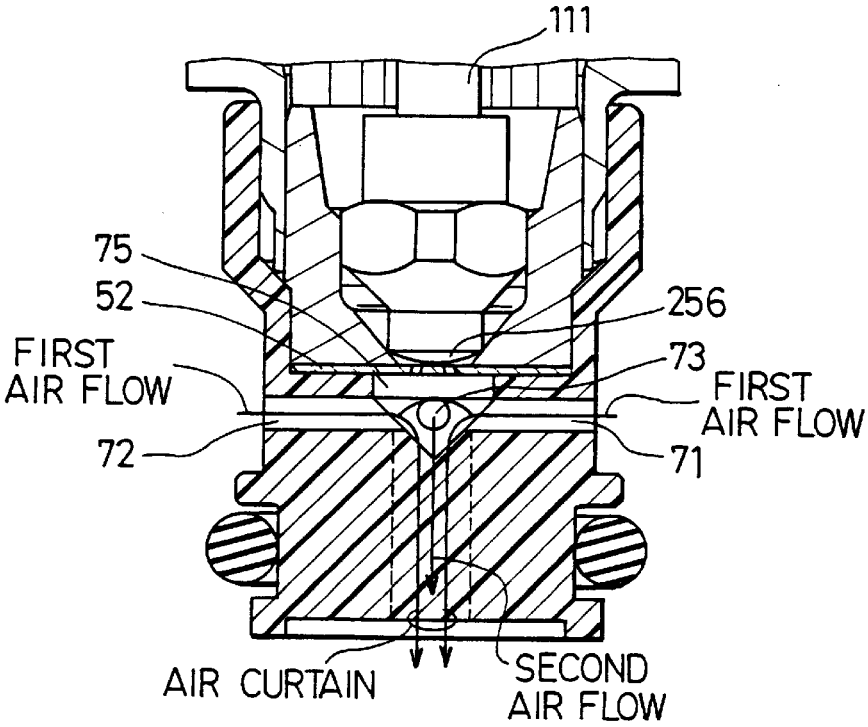
FIG. 11 is a cross-sectional view taken along the line XI—XI of FIG. 10.

(2) Fuel injected from each orifice is formed into two fuel flows which flow into a space portion 75. As shown FIG. 9, the first air flow flown in toward the center of the space portion 75 from the first air holes 71 and 72 collides to produce the secondary air flow perpendicular to the in-flow of the first air and flows toward the outside in the radial direction. The second air flow flowing toward the center of the space portion 75 from the second air holes 73 and 74 and the aforementioned air flow collide with the fuel flow injected from each orifice to the space portion 75 to atomize the fuel and sandwich the atomized spray. The atomized spray is sandwiched between the second air flow and the secondary air flow, in which state the aforesaid spray is guided to the separator 66 and pass through the fuel holes 67 and 68, as shown in FIGS. 10 and 11.

Figure 12:
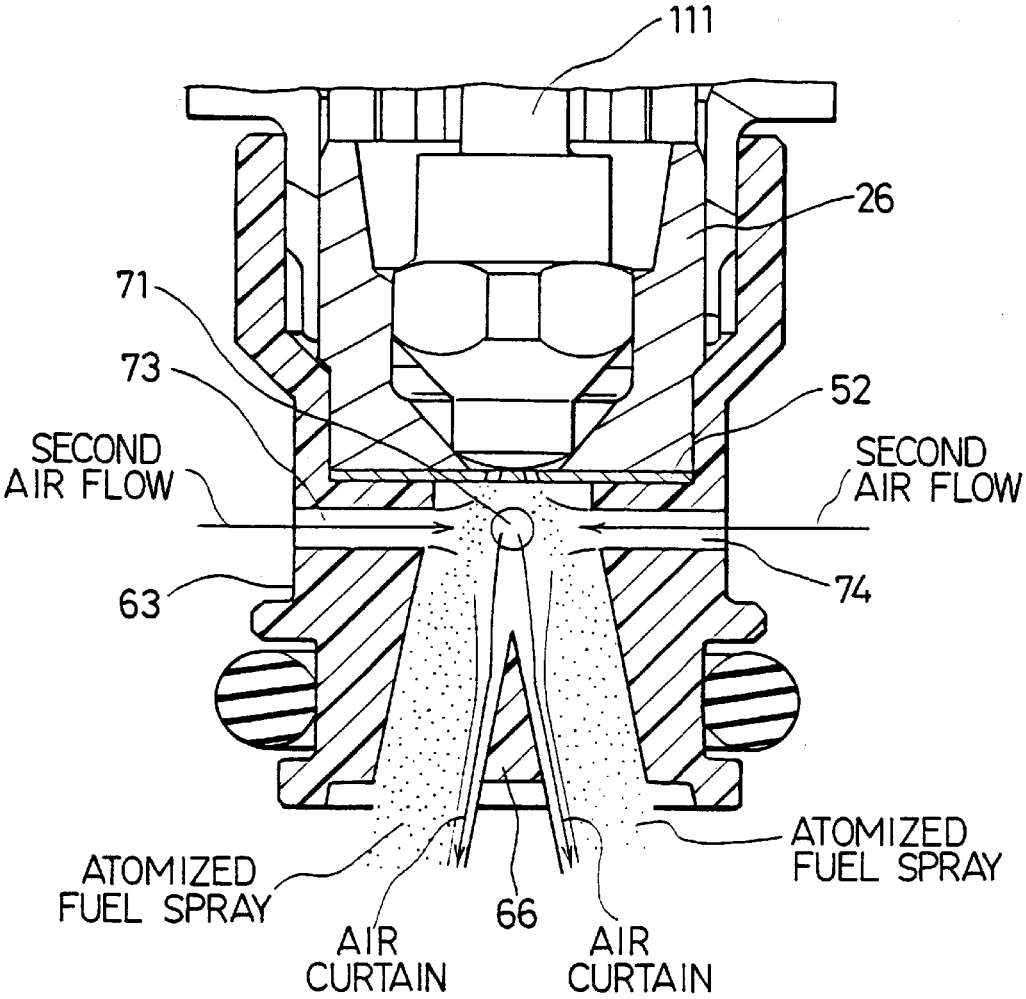
FIG. 12 is another explanatory view of the air flow in the third embodiment.

Since the first air flows flowing toward the center of the space portion 75 from the first air holes 71 and 72 collide with each other just downstream from the orifice plate 52, the secondary air flow after collision is suppressed from flowing toward the upstream side of the orifice plate 52. Accordingly, this air flow collides with the fuel flow to produce an air flow for further atomizing fuel and produce an air flow toward the downstream side of fuel along the separator 66 as shown in FIG. 12. The air flows flowing toward the downstream side of fuel along the separator 66 sandwich the atomized fuel spray therebetween and also function as an air curtain to prevent the fuel spray from being deposited on the wall surface of the separator 66.

Figure 14A:
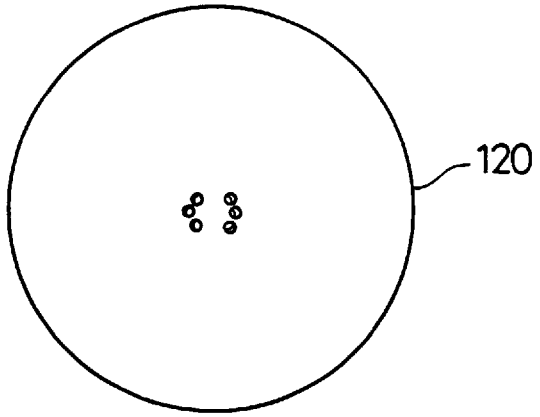
FIGS. 14A and 14B show main portions of the fuel injection apparatus for an internal combustion engine according to a fourth embodiment.
Figure 14B:
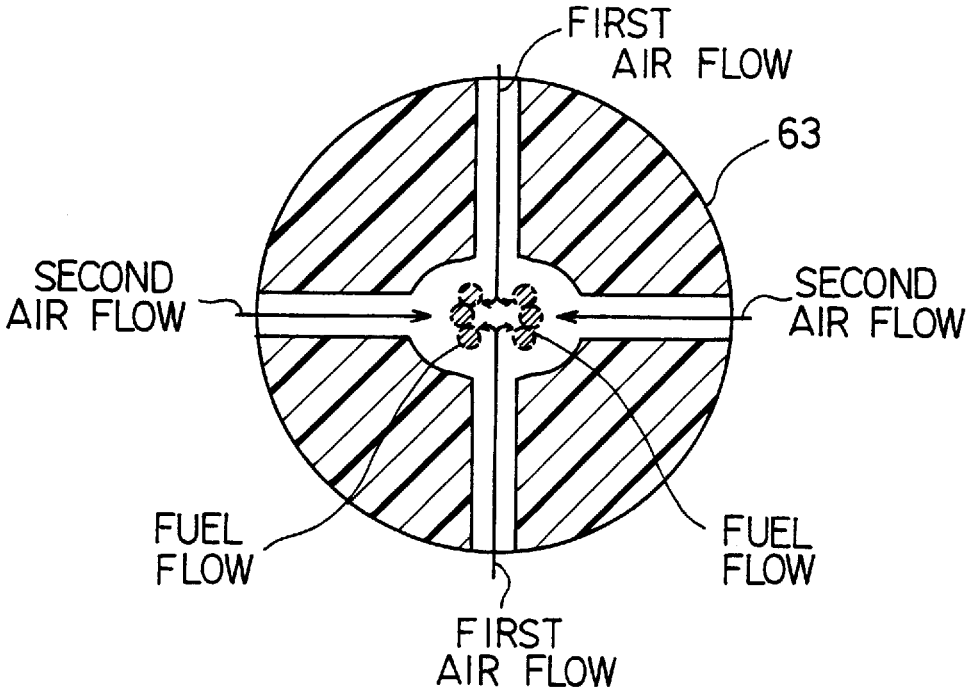

A fourth embodiment is described with reference to FIGS. 14A and 14B. In the fourth embodiment, the number of orifices formed at the orifice plate 120 is six, which differs from the third embodiment, as shown in FIG. 14A. A part of the fuel spray injected from each orifice is overlapped, and the fuel flows are formed as shown in FIG. 14B.

In the same manner as in the third embodiment, the atomization of the fuel can be obtained and the directional characteristics of the atomized fuel are also maintained.

A fifth embodiment is described with reference to FIGS. 15A and 15B.

Figure 15A:
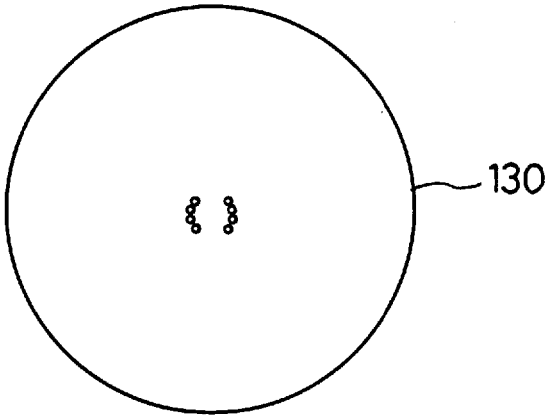
FIGS. 15A and 15B show main portions of the fuel injection apparatus for an internal combustion engine according to a fifth embodiment.
Figure 15B:
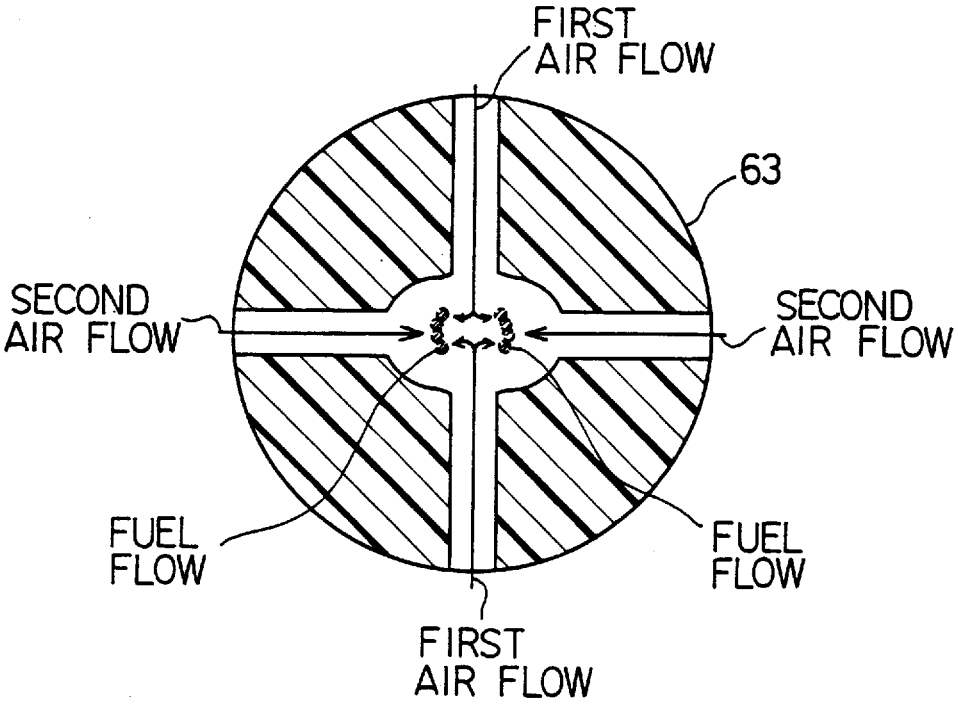

In the fifth embodiment, the number of orifices formed at the orifice plate 130 is eight, which differs from the third embodiment, as shown in FIG. 15A. A part of the fuel spray injected from each orifice is overlapped, and the fuel flows are formed as shown in FIG. 15B.

In the same manner as in the third embodiment, the atomization of the fuel can be obtained and the directional characteristics of the atomized fuel are also maintained.

Figure 16A:
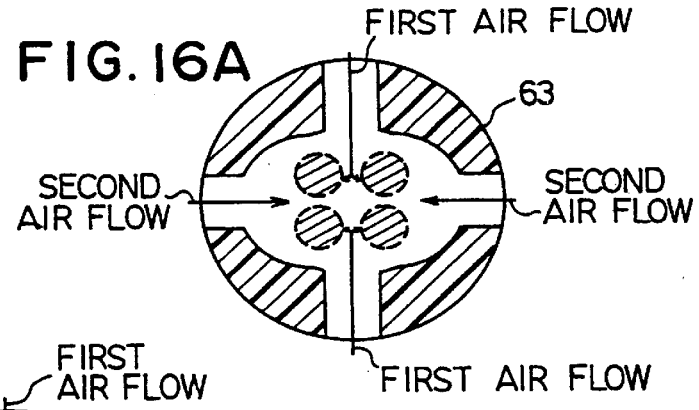
FIGS. 16A to 16C show modifications where each spray is not overlapped.
Figure 16B:
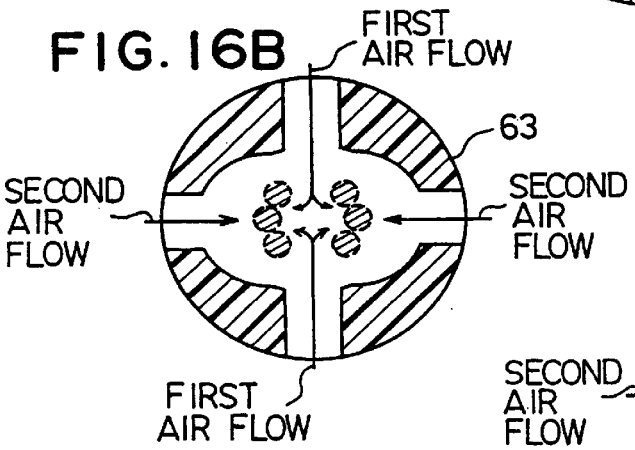
Figure 16C:
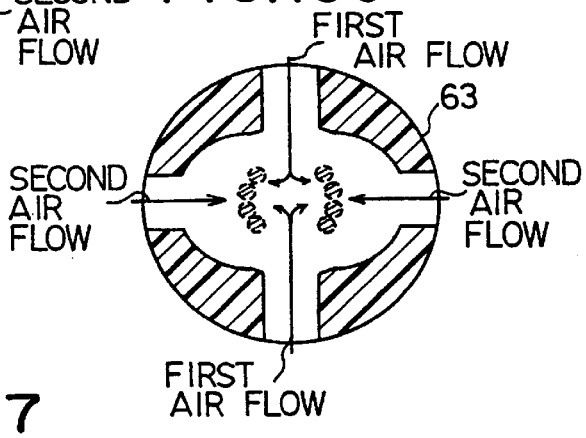
Figure 17:
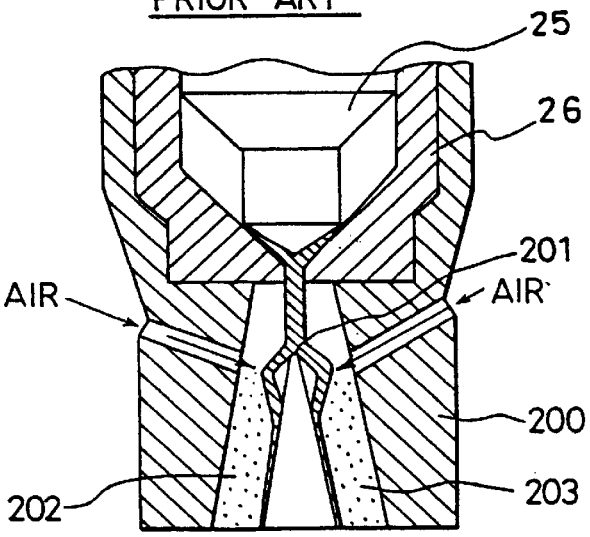
FIG. 17 PRIOR ART
FIG. 17 is a cross-sectional view of the conventional fuel injection apparatus for an internal combustion engine.

In each of the above embodiments, a fuel flow having a figure eight shaped cross-section where a part of fuel injected from each orifice is overlapped is described, however, the fuel flow may be formed to have two independent circular cross-sections or two ellipse cross-sections where fuel injected from each orifice is not overlapped. FIGS. 16A–16C show the cross-sections of the fuel flows where the fuel spray is not overlapped in cases that the number of the orifices is four, six, and eight, respectively. Further, the number of orifices may be two (not shown in the drawing), and the fuel spray from the orifice may directly form a fuel flow within the fuel hole.

In each of the above-described embodiments, both the first air hole and the second air hole are cylindrical in shape, however, it is to be noted that the sectional shape of the air holes according to the present invention is not limited thereto. Further, in each of the above-described embodiments, the first air hole and the second air hole are provided on the plane perpendicular to the axial direction of the air assist sleeve, however, it is to be noted that the provision thereof is not limited to the aforesaid plane. For example, the first air hole and the second air hole may be extended in the inclined direction.

Further, in each of the above-described embodiments, the multi-hole nozzle 61 is used for the sheet-like orifice plate 52, it is to be noted that in the present invention, means for performing the fuel direction control is not limited to the plate-like configuration.

Furthermore, while in the above-described embodiments, the example using the present invention is illustrated as the fuel atomization mechanism, it is to be noted that if use is intended for atomizing and injecting the fluid, the present invention can be applied to any atomization mechanism for fluid.

Although the present invention has been fully described in connection with the preferred embodiments thereof with reference to the accompanying drawings, it is to be noted that various changes and modifications will become more apparent to those skilled in the art. Such changes and modifications are to be understood as being included within the scope of the present invention as defined in the appended claims.

What is claimed is:

1. A fuel injection apparatus for an internal combustion engine, said apparatus comprising:

a valve body having a cylindrical hole and a conical slant face on the inlet side of said cylindrical hole;

a valve member having a contact portion adapted to abut on or move away from said conical slant face;

a multi-hole nozzle having a plurality of holes provided at an outlet of said cylindrical hole to control fuel injection direction; and an atomization mechanism provided on an outlet side of said multi-hole nozzle for atomizing fuel, said mechanism having a plurality of fuel holes with a diameter that is larger than that of said holes of said multi-hole nozzle and sandwiching a fuel flow from said multi-hole nozzle with an air flow formed by a plurality of first air flows after they have collided with each other and a second air flow.

2. A fuel injection apparatus for an internal combustion engine as in claim 1, wherein:

said atomization mechanism further includes a space in communication with said plurality of holes of said multi-hole nozzle, said space having a hole branched into said plurality of fuel holes on said outlet side, and two of said first air flows are introduced into said space from the outside.

3. A fuel injection apparatus for an internal combustion engine as in claim 1, wherein:

said atomization mechanism includes a space in communication with said plurality of holes of said multi-hole nozzle, said space having a hole branched into said plurality of fuel holes on the outlet side, and four of said first air flows are introduced into said space from the outside.

4. A fuel injection apparatus for an internal combustion engine as in claim 1, wherein:

the first air flow and the second air flow are introduced in a direction substantially perpendicular to the fuel flow through said multi-hole nozzle.

5. A fuel injection apparatus for an internal combustion engine as in claim 1, wherein:

said first air flow and said second air flow are introduced from a plurality of air introducing openings.

6. A fuel injection apparatus for an internal combustion engine as in claim 1, further comprising:

a separator for separating the fuel flow into each of said fuel holes.

7. A fuel injection apparatus for an internal combustion engine, said apparatus comprising:

a valve body having a cylindrical hole and a conical slant face formed on the inlet side of said cylindrical hole;

a valve member having a contact portion being adapted to abut on a part of said conical slant surface said valve member being adapted to abut on or move away from said part of said conical slant face;

a multi-hole nozzle having a plurality of holes provided at an outlet of said cylindrical hole to control fuel injection direction; and an atomization mechanism provided on an outlet side of said multi-hole nozzle for atomizing fuel said mechanism having a plurality of fuel holes having a larger diameter than said holes of said multi-hole nozzle and sandwiching a fuel flow having passed through said plurality of holes of said multi-hole nozzle by an air flow formed by a plurality of first air flows collided with each other within said fuel holes and a second air flow;

said atomization mechanism including a first air passage for introducing said first air flow and a second air passage for introducing said second air flow, and an angle formed between said first air passage and said second air passage being approximately right angle.

8. A fuel injection apparatus for an internal combustion engine according to claim 7, wherein said first air passage and said second air passage are formed substantially on the same plane.

9. A sleeve comprising:

two spray flow passages having divergent axes toward a downstream side;

a plurality of first air passages and second air passages for supplying a plurality of first air flows and a plurality of second air flows, respectively, said first and second air flows forming a main flow to be supplied from an outer-radial direction toward an inner-radial direction at an upstream side of said spray passages; and a separator for separating said spray into each of said spray flow passages, said spray being sandwiched between said spray passages by (a) a secondary air flow formed by colliding said first air flows with each other at an upstream collision point and (b) said second air flow.

10. A sleeve as in claim 9, wherein:

said first air flows and said second air flows are introduced in a direction substantially perpendicular to said spray injected into said spray flow passages.

11. A sleeve, as in claim 9, wherein:

said collision point is located within a spray surface formed by directions of said two spray flows, and said separator includes a wall surface formed along said spray direction.

12. A sleeve as in claim 9, wherein:

said first air passages and said second air passages are formed substantially on a common plane.

13. A sleeve as in claim 9, wherein:

the first air flows and the second air flows are introduced from a plurality of air introducing openings.

14. A sleeve according to claim 9, wherein:

a space into which said spray is introduced and into which said first air flows and said second air flows are introduced is provided on an upstream side of said separator.

15. A sleeve comprising:

two spray passages of which distance between flow passages is enlarged toward downstream side thereof and through which spray passes;

a plurality of first air passages and second air passages for supplying a plurality of first air flows and a plurality of second air flows, respectively, said first and second air flows forming a main flow to be supplied from an outer-radial direction toward an inner-radial direction at an upstream side of said spray passages, and a separator for separating said spray into each of said spray passages, said spray being sandwiched between said spray passages by a secondary air flow, which is formed by colliding said first air flows with each other at a collision point at an upstream side of said separator, and said second air flow, wherein an angle formed between said first air passage and the second air passage is approximately a right angle.

16. An injection apparatus comprising:

(A) a sleeve including:

(A1) two spray flow passages having divergent axes toward a downstream side thereof, (A2) a plurality of first air passages and second air passages for supplying a plurality of first air flows and a plurality of second air flows, respectively, said first and second air flows forming a main flow to be supplied from an outer-radial direction toward an inner-radial direction at an upstream side of said spray flow passages, and (A3) a separator for separating said spray into each of said spray flow passages, said spray sandwiched between said spray flow passages by (a) a secondary air flow formed by colliding said first air flows with each other at a collision point at an upstream side of said separator and (b) said second air flow; and (B) an orifice plate formed with a plurality of orifices for injecting two sprays toward inlets of said spray flow passages and disposed at an upstream side of said spray flow passages.

17. An injection valve as in claim 16 wherein fuel is injected from said spray flow passages into an internal combustion engine.

18. A fuel injection apparatus comprising:

a valve having a fuel outlet in fluid communication with a multi-holed nozzle;

an atomization chamber downstream of said nozzle leading to branched spray flow passages;

first oppositely situated air inlets to said chamber directing first air flows therethrough into collision with each other so as to thereafter be diverted toward fuel output from said nozzle; and second air inlets to said chamber directing second air flows toward fuel output from said nozzle in opposition to said diverted first air flows so that fuel flowing from the nozzle is sandwiched between at least one diverted first air flow and at least one opposingly directed second air flow so as to improve atomization of fuel sprays passing through said branched spray flow passages.

19. A fuel injection method comprising:

valving and passing fuel through a fuel outlet in fluid communication with a multi-holed nozzle and onward through an atomization chamber downstream of said nozzle leading, in turn, to branched spray flow passages;

directing first air flows through said chamber into collision with each other so as to thereafter be diverted toward fuel output from said nozzle; and also directing second air flows toward fuel output from said nozzle in opposition to said diverted first air flows so that fuel flowing from the nozzle is sandwiched between at least one diverted first air flow and at least one opposingly directed second air flow so as to improve atomization of fuel sprays passing through said branched spray flow passages.

* * * * *